US008817991B2

(12) United States Patent
Jaillet et al.

(10) Patent No.: US 8,817,991 B2
(45) Date of Patent: Aug. 26, 2014

(54) ADVANCED ENCODING OF MULTI-CHANNEL DIGITAL AUDIO SIGNALS

(75) Inventors: Florent Jaillet, Chateau-Arnoux (FR); David Virette, Munich (DE)

(73) Assignee: Orange, Paris (FR)

( * ) Notice: Subject to any disclaimer, the term of this patent is extended or adjusted under 35 U.S.C. 154(b) by 454 days.

(21) Appl. No.: 13/139,611

(22) PCT Filed: Dec. 11, 2009

(86) PCT No.: PCT/FR2009/052492

§ 371 (c)(1),
(2), (4) Date: Jun. 14, 2011

(87) PCT Pub. No.: WO2010/076460

PCT Pub. Date: Jul. 5, 2010

(65) Prior Publication Data

US 2011/0249822 A1 Oct. 13, 2011

(30) Foreign Application Priority Data

Dec. 15, 2008 (FR) ..... 08 58563

(51) Int. Cl.

| | |
|---|---|
| ***H04R 5/00*** | (2006.01) |
| ***G10L 19/008*** | (2013.01) |
| ***H04S 3/00*** | (2006.01) |
| *H04S 3/02* | (2006.01) |

(52) U.S. Cl.

CPC ..... *G10L 19/008* (2013.01); *H04S 2420/03* (2013.01); *H04S 2420/07* (2013.01); *H04S 3/008* (2013.01); *H04S 3/02* (2013.01); *H04S 2400/11* (2013.01)

USPC ..... 381/22; 381/23; 381/20; 704/503; 704/504; 704/E19.001

(58) Field of Classification Search

CPC ..... H04R 5/00

USPC ..... 381/17, 22–23, 20; 704/500, 503–504, 704/E19.001

See application file for complete search history.

(56) References Cited

U.S. PATENT DOCUMENTS

2007/0269063 A1* 11/2007 Goodwin et al. ..... 381/310

FOREIGN PATENT DOCUMENTS

WO WO 2007/104882 A1 9/2007

OTHER PUBLICATIONS

Cheng et al., "Encoding Independent Sources in Spatially Squeezed Surround Audio Coding," Advances in Multimedia Information Processing A PCM 2007, Lecture Notes in Computer Science, Springer Berlin Heidelberg, Berlin, Heidelberg, pp. 804-813 (Dec. 11, 2007).

Cheng et al., "A Spatial Squeezing Approach to Ambisonic Audio Compression," IEEE International Conference on Acoustics, Speech and Signal Processing, 2008, ICASSP 2008, Piscataway, NJ, USA, pp. 369-372, (Mar. 31, 2008).

* cited by examiner

*Primary Examiner* — Disler Paul

(74) *Attorney, Agent, or Firm* — Drinker Biddle & Reath LLP

(57) ABSTRACT

A method is provided for coding a multi-channel audio signal representing a sound scene comprising a plurality of sound sources. The method comprises decomposing the multi-channel signal into frequency bands and the following performed per frequency band: obtaining data representative of the direction of the sound sources of the sound scene, selecting a set of sound sources constituting principal sources, adapting the data representative of the direction of the selected principal sources, as a function of restitution characteristics of the multi-channel signal, determining a matrix for mixing the principal sources as a function of the adapted data, matrixing the principal sources by the matrix determined so as to obtain a sum signal with a reduced number of channels and coding the data representative of the direction of the sound sources and forming a binary stream comprising the coded data, the binary stream being transmittable in parallel with the sum signal.

11 Claims, 7 Drawing Sheets

ADVANCED ENCODING OF MULTI-CHANNEL DIGITAL AUDIO SIGNALS

The present invention pertains to the field of the coding/decoding of multi-channel digital audio signals.

More particularly, the present invention pertains to the parametric coding/decoding of multi-channel audio signals.

This type of coding/decoding is based on the extraction of spatialization parameters so that, on decoding, the listener's spatial perception can be reconstructed.

Such a coding technique is known by the name "Binaural Cue Coding" (BCC) which is on the one hand aimed at extracting and then coding the indices of auditory spatialization and on the other hand at coding a monophonic or stereophonic signal arising from a matrixing of the original multi-channel signal.

This parametric approach is a low-bitrate coding. The principal benefit of this coding approach is to allow a better compression rate than the conventional procedures for compressing multi-channel digital audio signals while ensuring the backward-compatibility of the compressed format obtained with the coding formats and broadcasting systems which already exist.

The MPEG Surround standard described in the document of the MPEG ISO/IEC standard 23003-1:2007 and in the document by "Breebaart, J. and Hotho, G. and Koppens, J. and Schuijers, E. and Oomen, W. and van de Par, S.," entitled "Background, concept, and architecture for the recent MPEG surround standard on multichannel audio compression" in Journal of the Audio Engineering Society 55-5 (2007) 331-351, describes a parametric coding structure such as represented in FIG. 1.

Thus, FIG. 1 describes such a coding/decoding system in which the coder 100 constructs a sum signal ("downmix") $S_s$ by matrixing at 110 the channels of the original multi-channel signal S and provides, via a parameters extraction module 120, a reduced set of parameters P which characterize the spatial content of the original multi-channel signal.

At the decoder 150, the multi-channel signal is reconstructed (S') by a synthesis module 160 which takes into account at one and the same time the sum signal and the parameters P transmitted.

The sum signal comprises a reduced number of channels. These channels may be coded by a conventional audio coder before transmission or storage. Typically, the sum signal comprises two channels and is compatible with conventional stereo broadcasting. Before transmission or storage, this sum signal can thus be coded by any conventional stereo coder. The signal thus coded is then compatible with the devices comprising the corresponding decoder which reconstruct the sum signal while ignoring the spatial data.

When this type of coding by matrixing of a multi-channel signal to obtain a sum signal is performed after transforming the multi-channel signal into the frequency space, problems in reconstructing the multi-channel signal can arise.

Indeed, in this typical case, there is not necessarily any spatial coherence between the sum signal and the restitution system on which the signal may be reproduced. For example, when the sum signal contains two channels, stereophonic restitution must make it possible to comply with the relative position of the sound sources in the reconstructed sound space. The left/right positioning of the sound sources must be able to be complied with.

Moreover, after matrixing based on frequency band, the resulting sum signal is thereafter transmitted to the decoder in the form of a temporal signal.

Switching from the time-frequency space to the temporal space involves interactions between the frequency bands and the close temporal frames which introduce troublesome defects and artifacts.

A requirement therefore exists for a frequency-band based parametric coding/decoding technique which makes it possible to limit the defects introduced by the switchings of the signals from the time-frequency domain to the temporal domain and to control the spatial coherence between the multi-channel audio signal and the sum signal arising from a matrixing of sound sources.

The present invention improves the situation.

For this purpose, it proposes a method for coding a multi-channel audio signal representing a sound scene comprising a plurality of sound sources. The method is such that it comprises a step of decomposing the multi-channel signal into frequency bands and the following steps per frequency band:

- obtaining of data representative of the direction of the sound sources of the sound scene;
- selection of a set of sound sources of the sound scene constituting principal sources;
- adaptation of the data representative of the direction of the selected principal sources, as a function of restitution characteristics of the multi-channel signal, by modification of the position of the sources so as to obtain a minimum separation between two sources;
- determination of a matrix for mixing the principal sources as a function of the adapted data;
- matrixing of the principal sources by the matrix determined so as to obtain a sum signal with a reduced number of channels;
- coding of the data representative of the direction of the sound sources and formation of a binary stream comprising the coded data, the binary stream being able to be transmitted in parallel with the sum signal.

Thus, when obtaining the sum signal, the mixing matrix takes into account information data regarding the direction of the sources. This makes it possible to adapt the resulting sum signal, for good restitution of the sound in space upon reconstruction of this signal at the decoder. The sum signal is thus adapted to the restitution characteristics of the multi-channel signal and to the overlaps, if any, in the positions of the sound sources. The spatial coherence between the sum signal and the multi-channel signal is thus complied with.

The adaptation of the data modifying the position of the sources so as to obtain a minimum separation between two sources thus makes it possible, for the two sources which, after sound restitution, would be too close to one another to be separated so that the restitution of the signal allows the listener to differentiate the position of these sources.

By separately coding the direction data and the sound sources per frequency band, use is made of the fact that the number of active sources in a frequency band is generally low, thereby increasing the coding performance.

It is not necessary to transmit other data for reconstructing the mixing matrix to the decoder since the matrix will be determined with the help of the coded directions data.

The various particular embodiments mentioned hereinafter may be added independently or in combination with one another, to the steps of the coding method defined hereinabove.

In one embodiment, the data representative of the direction are information regarding directivities representative of the distribution of the sound sources in the sound scene.

The directivity information associated with a source gives not only the direction of the source but also the shape, or the spatial distribution, of the source, that is to say the interaction that this source may have with the other sources of the sound scene.

The knowledge of this information regarding directivities, when associated with the sum signal, will allow the decoder to obtain a signal of better quality which takes into account the inter-channel redundancies in a global manner and the probable phase oppositions between channels.

In a particular embodiment, the coding of the information regarding directivities is performed by a parametric representation procedure.

This procedure is of low complexity and is particularly adapted to the case of synthesis sound scenes representing an ideal coding situation.

In another embodiment, the coding of the directivity information is performed by a principal component analysis procedure delivering base directivity vectors associated with gains allowing the reconstruction of the initial directivities.

This thus makes it possible to code the directivities of complex sound scenes whose coding cannot be represented easily by a model.

In yet another embodiment the coding of the directivity information is performed by a combination of a principal component analysis procedure and of a parametric representation procedure.

Thus, it is for example possible to perform the coding by both procedures in parallel and to choose the one which complies with a coding bitrate optimization criterion for example.

It is also possible to perform these two procedures in cascade so as simply to code some of the directivities by the parametric coding procedure and for those which are not modeled, to perform a coding by the principal component analysis procedure, so as to best represent all the directivities. The distribution of the bitrate between the two models for encoding the directivities possibly being chosen according to a criterion for minimizing the error in reconstructing the directivities.

In one embodiment of the invention, the method furthermore comprises the coding of secondary sources from among the unselected sources of the sound scene and insertion of coding information for the secondary sources into the binary stream.

The coding of the secondary sources will thus make it possible to afford additional accuracy regarding the decoded signal, especially for the complex signals of for example ambiophonic type.

The present invention also pertains to a method for decoding a multi-channel audio signal representing a sound scene comprising a plurality of sound sources, with the help of a binary stream and of a sum signal. The method is such that it comprises the following steps:

- extraction from the binary stream and decoding of data representative of the direction of the sound sources in the sound scene;
- adaptation of at least some of the direction data as a function of restitution characteristics of the multi-channel signal, by modification of the position of the sources obtained by the direction data, so as to obtain a minimum separation between two sources;
- determination of a matrix for mixing the sum signal as a function of the adapted data and calculation of an inverse mixing matrix;
- dematrixing of the sum signal by the inverse mixing matrix so as to obtain a set of principal sources;
- reconstruction of the multi-channel audio signal by spatialization at least of the principal sources with the decoded extracted data.

The decoded directions data will thus make it possible to retrieve the mixing matrix inverse to that used at the coder. This mixing matrix makes it possible to retrieve with the help of the sum signal, the principal sources which will be restored in space with good spatial coherence.

The adaptation step thus makes it possible to retrieve the directions of the sources to be spatialized so as to obtain sound restitution which is coherent with the restitution system.

The reconstructed signal is then well adapted to the restitution characteristics of the multi-channel signal by avoiding the overlaps, if any, in the positions of the sound sources.

Two overly close sources are thus separated so as to be restored in such a way that a listener can differentiate them.

In one embodiment, the decoding method furthermore comprises the following steps:

- extraction, from the binary stream, of coding information for coded secondary sources;
- decoding of the secondary sources with the help of the coding information extracted;
- grouping of the secondary sources with the principal sources for the spatialization.

The decoding of secondary sources then affords more accuracy regarding the sound scene.

The present invention also pertains to a coder of a multi-channel audio signal representing a sound scene comprising a plurality of sound sources. The coder is such that it comprises:

- a module for decomposing the multi-channel signal into frequency bands;
- a module for obtaining data representative of the direction of the sound sources of the sound scene;
- a module for selecting a set of sound sources of the sound scene constituting principal sources;
- a module for adapting the data representative of the direction of the selected principal sources, as a function of restitution characteristics of the multi-channel signal, by means for modifying the position of the sources so as to obtain a minimum separation between two sources;
- a module for determining a matrix for mixing the principal sources as a function of the data arising from the adaptation module;
- a module for matrixing the principal sources selected by the matrix determined so as to obtain a sum signal with a reduced number of channels;
- a module for coding the data representative of the direction of the sound sources; and
- a module for forming a binary stream comprising the coded data, the binary stream being able to be transmitted in parallel with the sum signal.

It also pertains to a decoder of a multi-channel audio signal representing a sound scene comprising a plurality of sound sources, receiving as input a binary stream and a sum signal. The decoder is such that it comprises:

- a module for extracting and decoding data representative of the direction of the sound sources in the sound scene;
- a module for adapting at least some of the direction data as a function of restitution characteristics of the multi-channel signal, by means for modifying the position of the sources obtained by the direction data, so as to obtain a minimum separation between two sources;
- a module for determining a matrix for mixing the sum signal as a function of the data arising from the module for adapting and for calculating an inverse mixing matrix;

a module for dematrixing the sum signal by the inverse mixing matrix so as to obtain a set of principal sources;

a module for reconstructing the multi-channel audio signal by spatialization at least of the principal sources with the decoded extracted data.

It finally pertains to a computer program comprising code instructions for the implementation of the steps of a coding method such as described and/or of a decoding method such as described, when these instructions are executed by a processor.

In a more general manner, a storage means, readable by a computer or a processor, optionally integrated into the coder, possibly removable, stores a computer program implementing a coding method and/or a decoding method according to the invention.

Other characteristics and advantages of the invention will be more clearly apparent on reading the following description, given solely by way of nonlimiting example and with reference to the appended drawings in which.

Figure 3A:
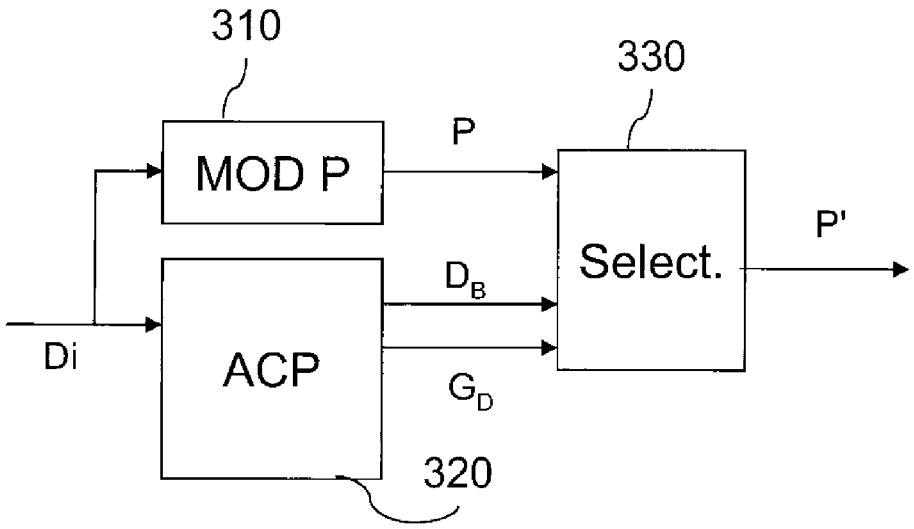
Figure 3B:
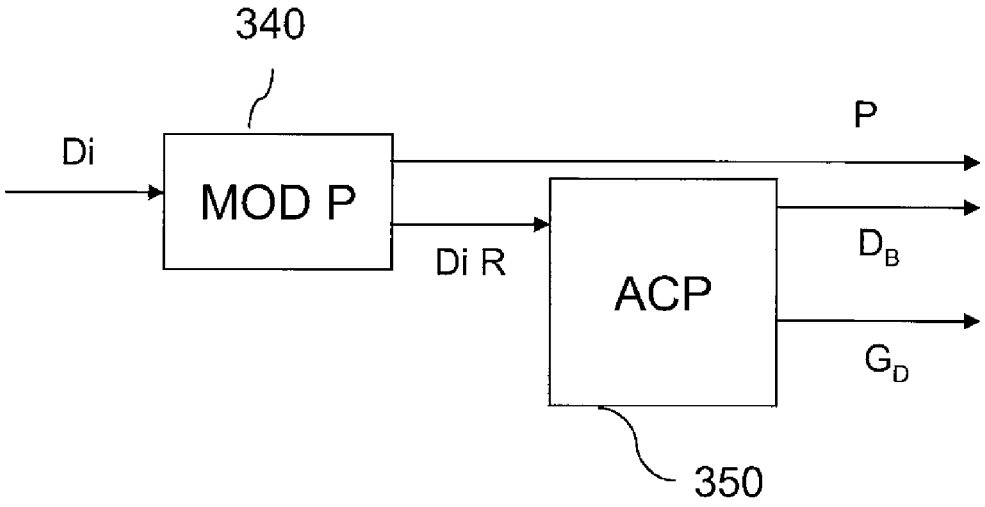
Figure 4:
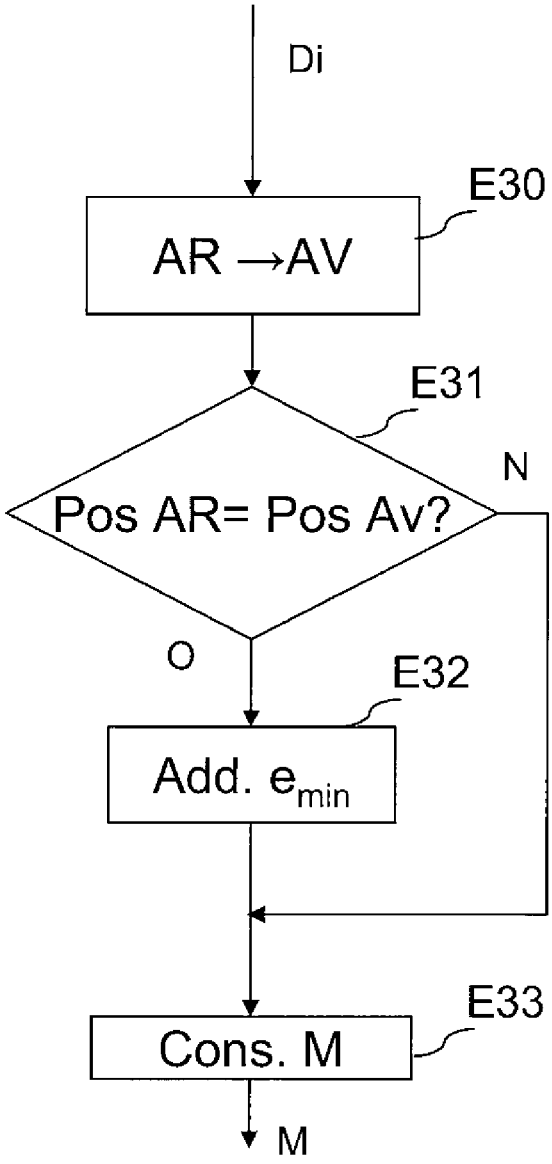
Figure 5A:
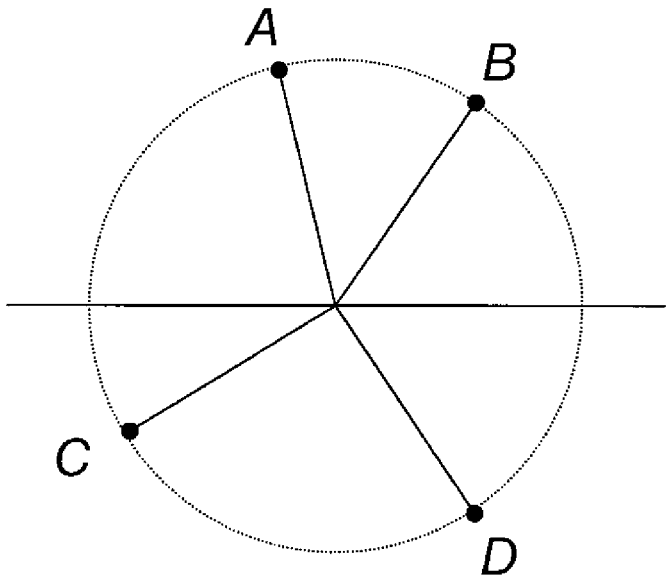
Figure 5B:
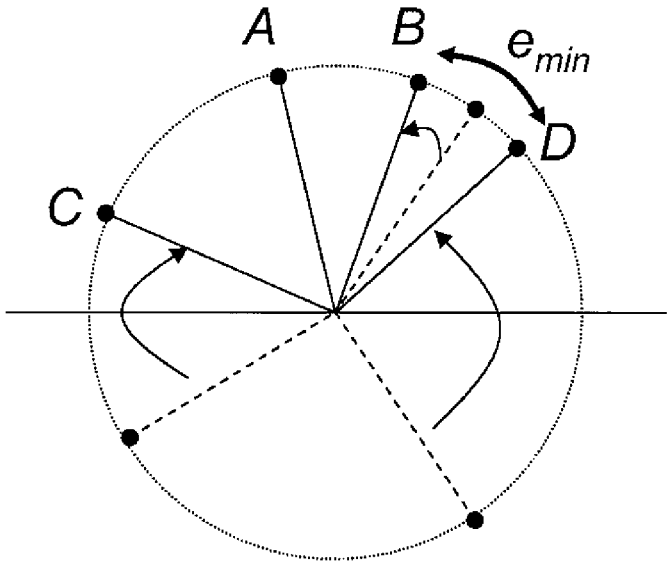
Figure 6:
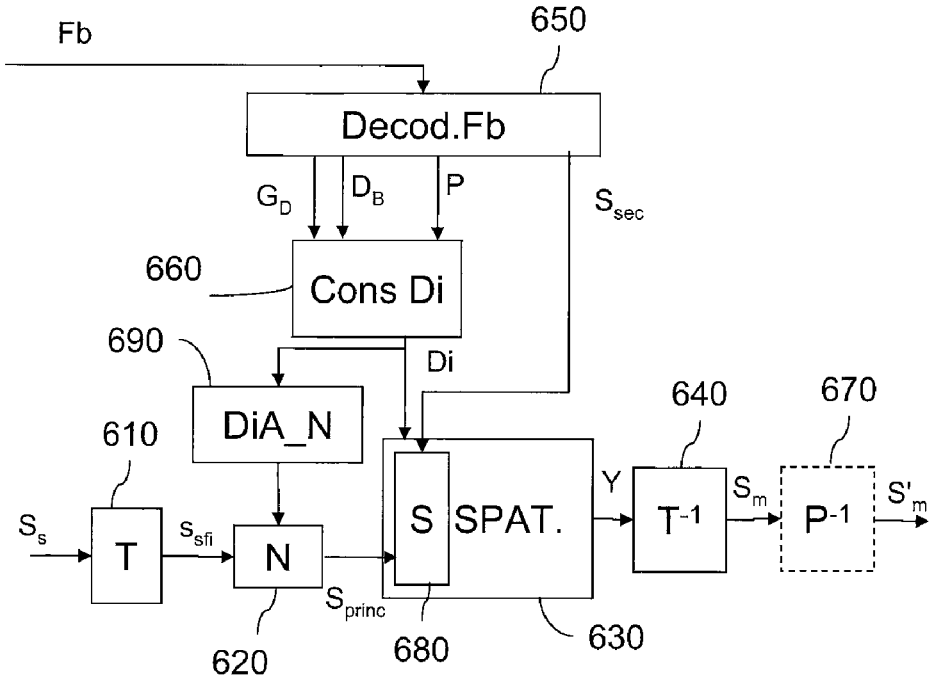
Figure 7A:
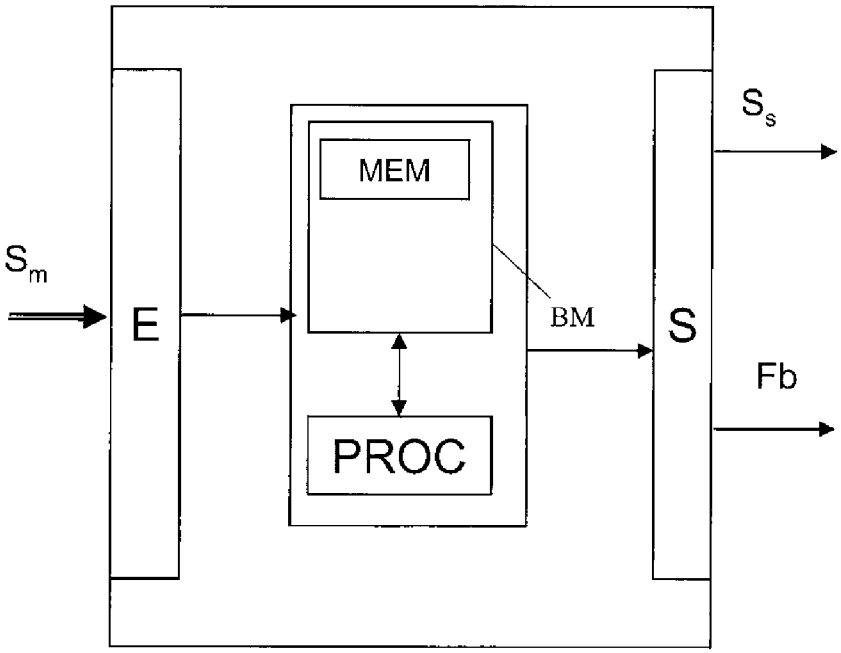
Figure 7B:
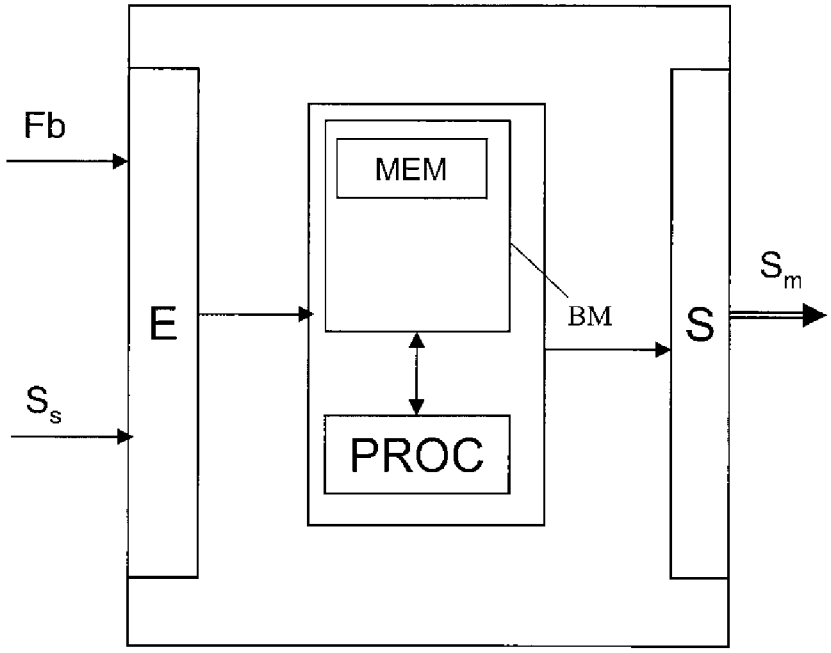

FIG. 3*a* illustrates a first embodiment of the coding of the directivities according to the invention;

FIG. 3*b* illustrates a second embodiment of the coding of the directivities according to the invention;

FIG. 4 illustrates a flowchart representing the steps of the determination of a mixing matrix according to one embodiment of the invention;

FIG. 5*a* illustrates an exemplary distribution of sound sources around a listener;

FIG. 5*b* illustrates the adaptation of the distribution of sound sources around a listener so as to adapt the sound sources direction data according to one embodiment of the invention;

FIG. 6 illustrates a decoder and a decoding method according to one embodiment of the invention; and FIGS. 7*a* and 7*b* represent respectively an exemplary device comprising a coder and an exemplary device comprising a decoder according to the invention.

Figure 1:
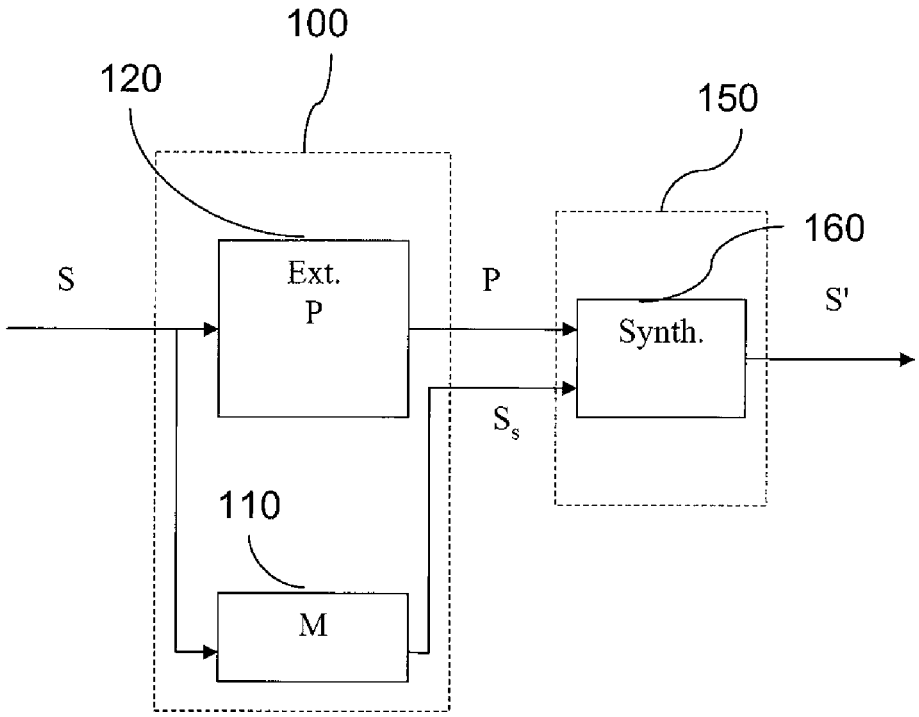
Fig.1 (Prior art)
FIG. 1 illustrates a coding/decoding system of the state of the art of MPEG Surround standardized system type.
Figure 2:
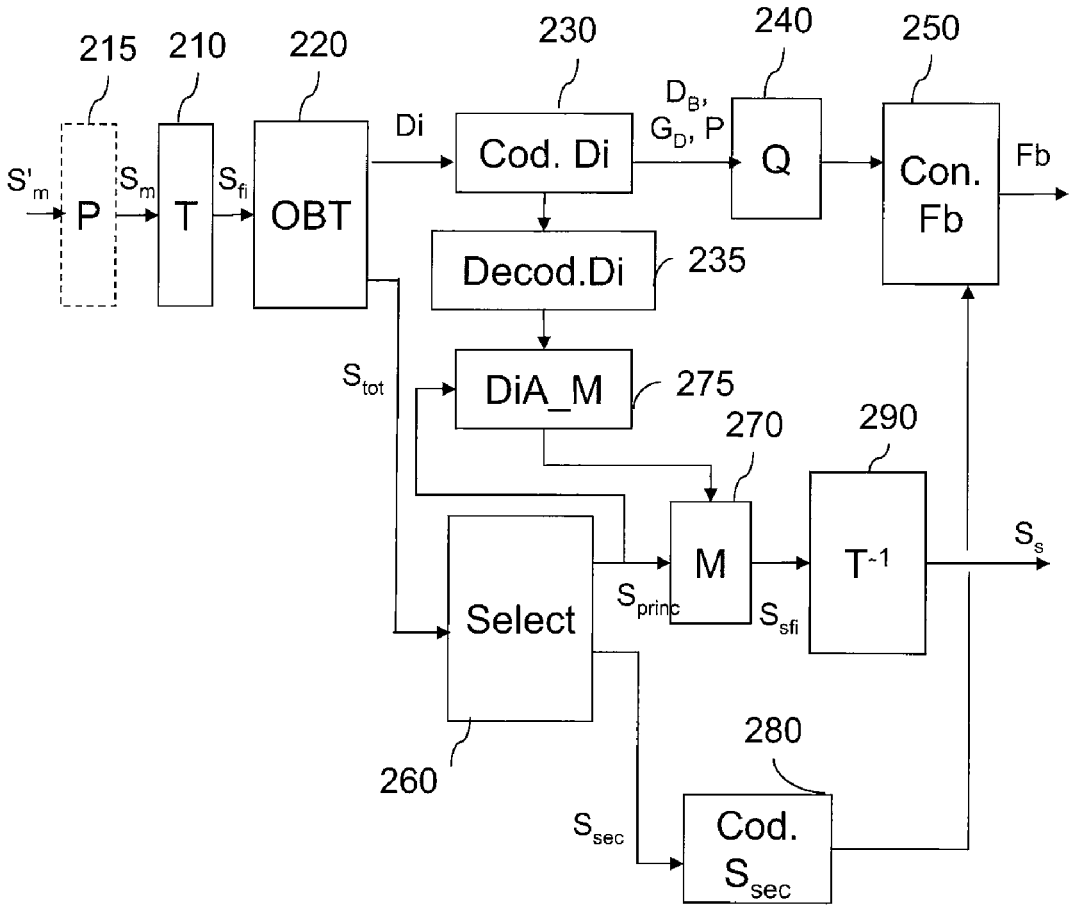
FIG. 2 illustrates a coder and a coding method according to one embodiment of the invention.

FIG. 2 illustrates in block diagram form, a coder according to one embodiment of the invention as well as the steps of a coding method according to one embodiment of the invention.

All the processing in this coder is performed per temporal frame. For the sake of simplification, the coder such as represented in FIG. 2 is represented and described by considering the processing performed on a fixed temporal frame, without showing the temporal dependence in the various notation.

One and the same processing is, however, applied successively to the set of temporal frames of the signal.

The coder thus illustrated comprises a time-frequency transform module 210 which receives as input an original multi-channel signal representing a sound scene comprising a plurality of sound sources.

This module therefore performs a step T of calculating the time-frequency transform of the original multi-channel signal $S_m$. This transform is effected for example by a short-term Fourier transform.

For this purpose, each of the $n_x$ channels of the original signal is windowed over the current temporal frame, and then the Fourier transform F of the windowed signal is calculated with the aid of a fast calculation algorithm on $n_{FFT}$ points. A complex matrix X of size $n_{FFT} \times n_x$ is thus obtained, containing the coefficients of the original multi-channel signal in the frequency space.

The processing operations performed thereafter by the coder are performed per frequency band. For this purpose, the matrix of coefficients X is split up into a set of sub-matrices $X_j$ each containing the frequency coefficients in the $j^{th}$ band.

Various choices for the frequency splitting of the bands are possible. In order to ensure that the processing is applied to real signals, bands are chosen which are symmetric with respect to the zero frequency in the short-term Fourier transform. Moreover, to optimize the coding effectiveness, preference is given to the choice of frequency bands approximating perceptive frequency scales, for example by choosing constant bandwidths in the ERB (for "Equivalent Rectangular Bandwidth") or Bark scales.

For the sake of simplification, the coding steps performed by the coder will be described for a given frequency band. The steps are of course performed for each of the frequency bands to be processed.

At the output of the module 210, the signal is therefore obtained for a given frequency band $S_{fj}$.

A module for obtaining directions data for the sound sources 220, makes it possible to determine by a step OBT, on the one hand, the direction data associated with each of the sources of the sound scene and on the other hand to determine the sources of the sound scene for the given frequency band.

The directions data may be for example data regarding direction of arrival of a source which correspond to the position of the source.

Data of this type are for example described in the document by M. Goodwin, J-M. Jot, "Analysis and synthesis for universal spatial audio coding", $121^{st}$ AES Convention, October 2006.

In another embodiment, the directions data are data regarding intensity differences between the sound sources. These intensity differences make it possible to define mean positions of the sources. They are for example called CLD (for "Channel Level Differences") for the MPEG Surround standardized coder.

In the embodiment described here in greater detail, the data representative of the directions of the sources are information regarding directivities.

The directivities information is representative of the spatial distribution of the sound sources in the sound scene.

The directivities are vectors of the same dimension as the number $n_s$ of channels of the multi-channel signal $S_m$.

Each source is associated with a directivity vector.

For a multi-channel signal, the directivity vector associated with a source corresponds to the weighting function to be applied to this source before playing it on a loudspeaker, so as to best reproduce a direction of arrival and a width of source.

It is readily understood that for a very significant number of regularly spaced loudspeakers, the directivity vector makes it possible to faithfully represent the radiation of a sound source. In the presence of an ambiophonic signal, the directivity vector is obtained by applying an inverse spherical Fourier transform to the components of the ambiophonic orders. Indeed, the ambiophonic signals correspond to a decomposition into spherical harmonics, hence the direct correspondence with the directivity of the sources.

The set of directivity vectors therefore constitutes a significant quantity of data that it would be too expensive to transmit directly for applications with low coding bitrate. To reduce the quantity of information to be transmitted, two procedures for representing the directivities can for example be used.

The module 230 for coding Cod·Di the information regarding directivities can thus implement one of the two procedures described hereinafter or else a combination of the two procedures.

A first procedure is a parametric modeling procedure which makes it possible to utilize the a priori knowledge about the signal format used. It consists in transmitting only a much reduced number of parameters and in reconstructing the directivities as a function of known coding models.

For example, it involves utilizing the knowledge about the coding of the plane waves for signals of ambiophonic type so as to transmit only the value of the direction (azimuth and elevation) of the source. With this information, it is then possible to reconstruct the directivity corresponding to a plane wave originating from this direction.

For example, for a defined ambiophonic order, the associated directivity is known as a function of the direction of arrival of the sound source. There are several existing procedures for estimating the parameters of the model. Thus a search for spikes in the directivity diagram (by analogy with sinusoidal analysis, as explained for example in the document "*Modélisation informatique du son musical* (*analyse, transformation, synthèse*)" [*Computerized modeling of musical sound* (*analysis, transformation, synthesis*)] by Sylvain Marchand, PhD thesis, Université Bordeaux 1, allows relatively faithful detection of the direction of arrival.

Other procedures such as "matching pursuit", as presented in S. Mallat, Z. Zhang, Matching pursuit with time-frequency dictionaries, IEEE Transactions on Signal Processing 41 (1993) 3397-3415, or parametric spectral analysis, can also be used in this context.

A parametric representation can also use a dictionary of simple form to represent the directivities. During the coding of the directivities, a datum is associated with an element of the dictionary, said datum being for example the corresponding azimuth and a gain making it possible to alter the amplitude of this directivity vector of the dictionary. It is thus possible, with the help of a directivity shape dictionary, to deduce therefrom the best shape or the combination of shapes which will make it possible to best reconstruct the initial directivity.

For the implementation of this first procedure, the module 230 for coding the directivities comprises a parametric modeling module which gives as output directivity parameters P. These parameters are thereafter quantized by the quantization module 240.

This first procedure makes it possible to obtain a very good level of compression when the scene does indeed correspond to an ideal coding. This will be the case particularly in synthesis sound scenes.

However, for complex scenes or those arising from microphone sound pick-ups, it is necessary to use more generic coding models, involving the transmission of a larger quantity of information.

The second procedure described hereinbelow makes it possible to circumvent this drawback. In this second procedure, the representation of the directivity information is performed in the form of a linear combination of a limited number of base directivities. This procedure relies on the fact that the set of directivities at a given instant generally has a reduced dimension. Indeed, only a reduced number of sources is active at a given instant and the directivity for each source varies little with frequency.

It is thus possible to represent the set of directivities in a group of frequency bands with the help of a very reduced number of well chosen base directivities. The transmitted parameters are then the base directivity vectors for the group of bands considered, and for each directivity to be coded, the coefficients to be applied to the base directivities so as to reconstruct the directivity considered.

This procedure is based on a principal component analysis (PCA) procedure. This tool is amply developed by I. T. Jolliffe in "Principal Component Analysis", Springer, 2002. The application of principal component analysis to the coding of the directivities is performed in the following manner: first of all, a matrix of the initial directivities Di is formed, the number of rows of which corresponds to the total number of sources of the sound scene, and the number of columns of which corresponds to the number of channels of the original multi-channel signal. Thereafter, the principal component analysis is actually performed, which corresponds to the diagonalization of the covariance matrix, and which gives the matrix of eigenvectors. Finally, the eigenvectors which carry the most significant share of information and which correspond to the eigenvalues of largest value are selected. The number of eigenvectors to be preserved may be fixed or variable over time as a function of the available bitrate. This new base therefore gives the matrix $D_B^T$. The gain coefficients associated with this base are easily calculated with the help of $G_B = Di \cdot D_B^T$.

In this embodiment, the representation of the directivities is therefore performed with the help of base directivities. The matrix of directivities Di may be written as the linear combination of these base directivities. Thus it is possible to write $Di = G_D D_B$, where $D_B$ is the matrix of base directivities for the set of bands and $G_D$ the matrix of associated gains. The number of rows of this matrix represents the total number of sources of the sound scene and the number of columns represents the number of base directivity vectors.

In a variant of this embodiment, base directivities are dispatched per group of bands considered, so as to more faithfully represent the directivities. It is possible for example to provide two base directivity groups: one for the low frequencies and one for the high frequencies. The limit between these two groups can for example be chosen between 5 and 7 kHz.

For each frequency band, the gain vector associated with the base directivities is thus transmitted.

For this embodiment, the coding module 230 comprises a principal component analysis module delivering base directivity vectors $D_B$ and associated coefficients or gain vectors $G_D$.

Thus, after PCA, a limited number of directivity vectors will be coded and transmitted. For this purpose, use is made of a scalar quantization performed by the quantization module 240, coefficients and base directivity vectors. The number of base vectors to be transmitted may be fixed, or else selected at the coder by using for example a threshold on the mean square error between the original directivity and the reconstructed directivity. Thus, if the error is below the threshold, the base vector or vectors so far selected are sufficient, it is not then necessary to code an additional base vector.

In variant embodiments, the coding of the directivities is carried out by a combination of the two representations listed hereinabove. FIG. 3*a* illustrates, in a detailed manner, the directivities coding block 230 in a first variant embodiment.

This mode of coding uses the two schemes for representing the directivities. Thus, a module 310 performs a parametric modeling as explained previously so as to provide directivity parameters (P).

A module 320 performs a principal component analysis so as to provide at one and the same time base directivity vectors ($D_B$) and associated coefficients ($G_D$).

In this variant a selection module 330 chooses frequency band by frequency band, the best mode of coding for the directivity by choosing the best directivities reconstruction/bitrate compromise.

For each directivity, the choice of the representation adopted (parametric representation or linear combination of base directivities) is made so as to optimize the effectiveness of the compression.

A selection criterion is for example the minimization of the mean square error. A perceptual weighting may optionally be used for the choice of the directivity coding mode. The aim of this weighting is for example to favor the reconstruction of the directivities in the frontal zone, for which the ear is more sensitive. In this case, the error function to be minimized in the case of the PCA-based coding model can take the following form:

$$E=(W(Di-G_D D_B))^2$$

With Di, the original directivities and W, the perceptual weighting function.

The directivity parameters arising from the selection module are thereafter quantized by the quantization module 240 of FIG. 2.

In a second variant of the coding block 230, the two modes of coding are cascaded. FIG. 3*b* illustrates this coding block in detail. Thus, in this variant embodiment, a parametric modeling module 340 performs a modeling for a certain number of directivities and provides as output at one and the same time directivity parameters (P) for the modeled directivities and unmodeled directivities or residual directivities DiR.

These residual directivities (DiR) are coded by a principal component analysis module 350 which provides as output base directivity vectors ($D_B$) and associated coefficients ($G_D$).

The directivity parameters, the base directivity vectors as well as the coefficients are provided as input for the quantization module 240 of FIG. 2.

The quantization Q is performed by reducing the accuracy as a function of data about perception, and then by applying an entropy coding. Hence, possibilities for utilizing the redundancy between frequency bands or between successive frames may make it possible to reduce the bitrate. Intra-frame or inter-frame predictions about the parameters can therefore be used. Generally, conventional quantization procedures will be able to be used. Moreover, the vectors to be quantized being orthonormal, this property may be utilized during the scalar quantization of the components of the vector. Indeed, for a vector of dimension N, only N−1 components will have to be quantized, the last component being able to be recalculated.

At the output of the coding module 230 for the directions data Di of FIG. 2, the parameters thus intended for the decoder are decoded by the internal decoding module 235 so as to retrieve the same information as that which the decoder will have after reception of the coded directions data for the principal sources selected by the module 260 described subsequently. Principal directions are thus obtained.

When dealing with directions data in the form of direction of arrival of the sources, the information may be taken into account as is.

When the data are in the form of difference in intensity between the sources, a step of calculating the mean position of the sources is performed so as to use this information in the module for determining the mixing matrix 275.

Finally, when the data are information regarding directivities, the module 235 determines a single position per source by computing a mean of the directivities. This mean can for example be calculated as the barycenter of the directivity vector. These single positions or principal directions are thereafter used by the module 275.

The latter determines initially, the directions of the principal sources and adapts them as a function of spatial coherence criterion, knowing the multi-channel signal restitution system.

In the case of stereophonic restitution, for example, the restitution is performed by two loudspeakers situated in front of the listener.

In this typical case, the steps implemented by the module 275 are described with reference to FIG. 4.

Thus, with the help of the information about the position of the sources as well as the knowledge of the restitution characteristics, the sources positioned to the rear of the listener are brought back toward the front in step E30 of FIG. 4.

With reference to FIGS. 5*a* and 5*b*, the steps of adapting the position of the sources are illustrated. Thus, FIG. 5*a* represents an original sound scene with 4 sound sources (A, B, C and D) distributed around the listener.

The sources C and D are situated at the rear of the listener centered at the center of the circle. The sources C and D are brought back toward the front of the scene by symmetry.

FIG. 5*b* illustrates this operation, in the form of arrows.

Step E 31 of FIG. 4 performs a test to ascertain whether the previous operation causes an overlap of the positions of the sources in space. In the example of FIG. 5*b*, this is for example the case for the sources B and D which, after the operation of step E30, are situated at a distance which does not make it possible to differentiate them.

If there exist sources in such a situation (positive test of step E31), step E32, modifies the position of one of the two sources in question so as to position it at a minimum distance $e_{min}$ which allows the listener to differentiate these talkers. The separation is done symmetrically with respect to the point equidistant from the two sources so as to minimize the displacement of each. If the sources are placed too near the limit of the sound image (extreme left or right), the source closest to this limit is positioned at this limit position, and the other source is placed with the minimum separation with respect to the first source.

In the example illustrated in FIG. 5*b*, it is the source B which is shifted in such a way that the distance $e_{min}$ separates the sources B and D.

If the test of step E31 is negative, the positions of the sources are maintained and step E33 is implemented. This step consists in constructing a mixing matrix with the help of the information regarding positions of the sources thus defined in the earlier steps.

In the case of a restitution of the signal by a system of 5.1 type, the loudspeakers are distributed around the listener. It is then not necessary to implement step E30 which brings back the sources situated to the rear of the listener toward the front.

On the other hand, step E32 of modifying the distances between two sources is possible. Indeed, when one wishes to position a sound source between two loudspeakers of the 5.1 restitution system, it may happen that two sources are situated at a distance which does not allow the listener to differentiate them.

The directions of the sources are therefore modified to obtain a minimum distance between two sources, as explained previously.

The mixing matrix is therefore determined in step E33, as a function of the directions obtained after or without modifications.

This matrix is constructed so as to ensure the spatial coherence of the sum signal, that is to say if it alone is restored, the sum signal already makes it possible to obtain a sound scene where the relative position of the sound sources is complied with: a frontal source in the original scene will be well perceived facing the listener, a source to the left will be perceived to the left, a source further to the left will also be perceived further to the left, likewise to the right.

With these new angle values, an invertible matrix is constructed.

The various alternatives for choosing the mixing matrix are related to the various spatial distribution laws or "panning" (sine, tangent law, etc) presented in "Spatial sound generation and perception by amplitude panning techniques", PhD thesis, Helsinki University of Technology, Espoo, Finland, 2001, V. Pulkki.

It is for example possible, advantageously to choose to represent the right pathways by a sine shape and the left pathways by a cosine shape, so as to render this matrix reversible.

Moreover, so that the extreme positions (−45° and 45°) are well represented, it is for example possible to choose weighting coefficients set to 1 for the left pathway and to 0 for the right pathway so as to represent the signal in the −45° position and conversely so as to represent the signal at 45°.

So that the central position at 0° is well represented, the matrixing coefficients for the left pathway and for the right pathway must be equal.

An example of determining the mixing matrix is explained hereinbelow.

By choosing the "panning" law to be a tangent law, the gains associated with a source for a stereophonic sum signal (2 channels) are calculated in the following manner:

$$g_{Gs1}=\cos\theta_{s1}$$

$$g_{Ds2}=\sin\theta_{s1}$$

$\theta_{S1}$ being the angle between the source 1 and the left loudspeaker, when considering the aperture between the loudspeakers of 90°.

The sum signal $S_{sfi}$ is therefore obtained through the following operation:

$$S_{sfi}=S_{princ}M$$

With $$M=\begin{bmatrix} g_{Gs1} & g_{Ds1} \\ g_{Gs2} & g_{Ds2} \end{bmatrix}$$

Returning to the description of FIG. 2, the coder such as described here furthermore comprises a selection module 260 able to select in the Select step principal sources ($S_{princ}$) 1 from among the sources of the sound scene to be coded ($S_{tot}$).

For this purpose, a particular embodiment uses a procedure of principal component analysis (PCA) in each frequency band in the block 220 so as to extract all the sources from the sound scene ($S_{tot}$). This analysis makes it possible to rank the sources in sub-bands by order of importance according to the energy level for example.

The sources of greater importance (therefore of greater energy) are then selected by the module 260 so as to constitute the principal sources ($S_{princ}$), which are thereafter matrixed by the module 270, by the matrix M such as defined by the module 275, so as to construct a sum signal ($S_{sfi}$) (or "downmix").

This sum signal per frequency band undergoes an inverse time-frequency transform $T^{-1}$ by the inverse transform module 290 so as to provide a temporal sum signal ($S_s$). This sum signal is thereafter encoded by a speech coder or an audio coder of the state of the art (for example: G.729.1 or MPEG-4 AAC).

Secondary sources ($S_{sec}$) may be coded by a coding module 280 and added to the binary stream in the binary stream construction module 250.

For these secondary sources, that is to say the sources which are not transmitted directly in the sum signal, there exist various processing alternatives.

These sources being considered to be non-essential to the sound scene, they need not be transmitted.

It is however possible to code some or the entirety of these secondary sources by the coding module 280 which can in one embodiment be a short-term Fourier transform coding module. These sources can thereafter be coded separately by using the aforementioned audio or speech coders.

In a variant of this coding, it is possible for the coefficients of the transform of these secondary sources to be coded directly only in the bands which are reckoned to be important.

The secondary sources may be coded by parametric representations, these representations may be in the form of a spectral envelope or temporal envelope.

These representations are coded in the step Cod·$S_{sec}$ of the module 280 and inserted in the step Con·Fb of the module 250, into the binary stream with the quantized coded directivities information. These parametric representations then constitute coding information for the secondary sources.

In the case of certain multi-channel signals especially of ambiophonic type, the coder such as described implements an additional step of pre-processing P by a pre-processing module 215.

This module performs a step of change of base so as to express the sound scene using the plane wave decomposition of the acoustic field.

The original ambiophonic signal is seen as the angular Fourier transform of a sound field. Thus the various components represent the values for the various angular frequencies. The first operation of decomposition into plane waves therefore corresponds to taking the omnidirectional component of the ambiophonic signal as representing the zero angular frequency (this component is indeed therefore a real component). Thereafter, the following ambiophonic components (order 1, 2, 3, etc. . . . ) are combined to obtain the complex coefficients of the angular Fourier transform.

For a more precise description of the ambiophonic format, refer to the thesis by Jérôme Daniel, entitled "Représentation de champs acoustiques, application à la transmission et à la reproduction de scènes sonores complexes dans un contexte multimédia" [Representation of acoustic fields, application to the transmission and reproduction of complex sound scenes in a multimedia context] 2001, Paris 6.

Thus, for each ambiophonic order greater than 1 (in 2-dimensions), the first component represents the real part, and the second component represents the imaginary part. For a two-dimensional representation, for an order O, we obtain O+1 complex components. A Short-Term Fourier Transform (in temporal dimension) is thereafter applied to obtain the Fourier transforms (in the frequency domain) of each angular harmonic. This step then incorporates the transformation step T of the module 210. Thereafter, the complete angular transform is constructed by recreating the harmonics of negative frequencies by Hermitian symmetry. Finally, an inverse Fourier transform in the dimension of the angular frequencies is performed so as to pass to the directivities domain.

This pre-processing step P allows the coder to work in a space of signals whose physical and perceptive interpretation is simplified, thereby making it possible to more effectively utilize the knowledge about spatial auditory perception and thus improve the coding performance. However, the coding of the ambiophonic signals remains possible without this pre-processing step.

For signals not arising from ambiophonic techniques, this step is not necessary. For these signals, the knowledge of the capture or restitution system associated with the signal makes it possible to interpret the signals directly as a plane wave decomposition of the acoustic field.

FIG. 6 now describes a decoder and a decoding method in one embodiment of the invention.

This decoder receives as input the binary stream $F_b$ such as constructed by the coder previously described as well as the sum signal $S_s$.

In the same manner as for the coder, all the processing operations are performed per temporal frame. To simplify the notation, the description of the decoder which follows describes only the processing performed on a fixed temporal frame and does not show the temporal dependence in the notation. In the decoder, this same processing is, however, applied successively to all the temporal frames of the signal.

The decoder thus described comprises a module 650 for decoding Decod·Fb the information contained in the binary stream Fb received.

The information regarding directions and more particularly here, regarding directivities, is therefore extracted from the binary stream.

The possible outputs from this binary stream decoding module depend on the procedures for coding the directivities used in the coding. They may be in the form of base directivity vectors $D_B$ and of associated coefficients $G_D$ and/or modeling parameters P.

These data are then transmitted to a module for reconstructing the information regarding directivities 660 which performs the decoding of the information regarding directivities by operations inverse to those performed on coding.

The number of directivity to be reconstructed is equal to the number $n_{tot}$ of sources in the frequency band considered, each source being associated with a directivity vector.

In the case of representing the directivities with the help of base directivity, the matrix of the directivities Di may be written as the linear combination of these base directivities. Thus it is possible to write $Di=G_D D_B$, where $D_B$ is the matrix of the base directivities for the set of bands and $G_D$ the matrix of the associated gains. This gain matrix has a number of rows equal to the total number of sources $n_{tot}$, and a number of columns equal to the number of base directivity vectors.

In a variant of this embodiment, base directivities are decoded per group of frequency bands considered, so as to more faithfully represent the directivities. As explained in respect of the coding, it is for example possible to provide two groups of base directivities: one for the low frequencies and one for the high frequencies. A vector of gains associated with the base directivities is thereafter decoded for each band.

Ultimately, as many directivities as sources are reconstructed. These directivities are grouped together in a matrix Di where the rows correspond to the angle values (as many angle values as channels in the multi-channel signal to be reconstructed), and each column corresponds to the directivity of the corresponding source, that is to say column r of Di gives the directivity of the source which is in column r of S.

A module 690 for defining the principal directions of the sources and for determining the mixing matrix N receives this information regarding decoded directions or directivities.

This module firstly calculates the principal directions by computing for example a mean of the directivities received so as to find the directions. As a function of these directions, a mixing matrix, inverse to that used for the coding, is determined.

Knowing the "panning" laws used for the mixing matrix at the coder, the decoder is capable of reconstructing the inverse mixing matrix with the direction information corresponding to the directions of the principal sources.

The directivity information is transmitted separately for each source. Thus, in the binary stream, the directivities relating to the principal sources and the directivities of the secondary sources are clearly identified.

It should be noted that this decoder does not need any other information to calculate this matrix since it is dependent on the direction information received in the binary stream.

The same algorithm as that described with reference to FIG. 4 is then implemented in the module 690 so as to retrieve the mixing matrix adapted to the restitution envisaged for the sum signal.

The number of rows of the matrix N corresponds to the number of channels of the sum signal, and the number of columns corresponds to the number of principal sources transmitted.

The inverse matrix N such as defined is thereafter used by the dematrixing module 620.

The decoder therefore receives, in parallel with the binary stream, the sum signal $S_s$. The latter undergoes a first step of time-frequency transform T by the transform module 610 so as to obtain a sum signal per frequency band, $S_{sfi}$.

This transform is carried out using for example the short-term Fourier transform. It should be noted that other transforms or banks of filters may also be used, and especially banks of filters that are non-uniform according to a perception scale (e.g. Bark). It may be noted that in order to avoid discontinuities during the reconstruction of the signal with the help of this transform, an overlap add procedure is used.

For the temporal frame considered, the step of calculating the short-term Fourier transform consists in windowing each of the $n_f$ channels of the sum signal $S_s$ with the aid of a window w of greater length than the temporal frame, and then in calculating the Fourier transform of the windowed signal with the aid of a fast calculation algorithm on $n_{FFT}$ points. This therefore yields a complex matrix F of size $n_{FFT} \times n_f$ containing the coefficients of the sum signal in the frequency space.

Hereinafter, the whole of the processing is performed per frequency band. For this purpose, the matrix of the coefficients F is split into a set of sub-matrices $F_j$ each containing the frequency coefficients in the $j^{th}$ band. Various choices for the frequency splitting of the bands are possible. In order to ensure that the processing is applied to real signals, bands which are symmetric with respect to the zero frequency in the short-term Fourier transform are chosen. Moreover, so as to optimize the decoding effectiveness, preference is given to the choice of frequency bands approximating perceptive frequency scales, for example by choosing constant bandwidths in the ERB or Bark scales.

For the sake of simplification, the decoding steps performed by the decoder will be described for a given frequency band. The steps are of course performed for each of the frequency bands to be processed.

The frequency coefficients of the transform of the sum signal of the frequency band considered are matrixed by the module 620 by the matrix N determined according to the determination step described previously so as to retrieve the principal sources of the sound scene.

More precisely, the matrix $S_{princ}$, of the frequency coefficients for the current frequency band of the $n_{princ}$ principal sources is obtained according to the relation:

$S_{princ}$=BN, where N is of dimension $n_f \times n_{princ}$ and B is a matrix of dimension $n_{bin} \times n_f$ where $n_{bin}$ is the number of frequency components (or bins) adopted in the frequency band considered.

The rows of B are the frequency components in the current frequency band, the columns correspond to the channels of the sum signal. The rows of $S_{princ}$ are the frequency components in the current frequency band, and each column corresponds to a principal source.

When the scene is complex, it may happen that the number of sources to be reconstructed in the current frequency band in order to obtain a satisfactory reconstruction of the scene is greater than the number of channels of the sum signal.

In this case, additional or secondary sources are coded and then decoded with the help of the binary stream for the current band by the binary stream decoding module 650.

This decoding module then decodes the secondary sources, in addition to the information regarding directivities.

The decoding of the secondary sources is performed by the inverse operations to those which were performed on coding.

Whatever coding procedure has been adopted for the secondary sources, if data for reconstructing the secondary sources have been transmitted in the binary stream for the current band, the corresponding data are decoded so as to reconstruct the matrix $S_{sec}$ of the frequency coefficients in the current band of the $n_{sec}$ secondary sources. The form of the matrix $S_{sec}$ is similar to the matrix $S_{princ}$, that is to say the rows are the frequency components in the current frequency band, and each column corresponds to a secondary source.

It is thus possible to construct the complete matrix S at 680, frequency coefficients of the set of $n_{tot}=n_{princ}+n_{sec}$ sources necessary for the reconstruction of the multi-channel signal in the band considered, obtained by grouping together the two matrices $S_{princ}$ and $S_{supp}$ according to the relation $S=(S_{princ}\text{-}S_{supp})$. S is therefore a matrix of dimension $n_{bin} \times n_{tot}$. Hence, the shape is identical to the matrices $S_{princ}$ and $S_{supp}$: the rows are the frequency components in the current frequency band, each column is a source, with $n_{tot}$ sources in total.

With the help of the matrix S of coefficients of the sources and of the matrix Di of associated directivities, the frequency coefficients of the multi-channel signal reconstructed in the band are calculated in the spatialization module 630, according to the relation:

$Y=SD^T$, where Y is the signal reconstructed in the band. The rows of the matrix Y are the frequency components in the current frequency band, and each column corresponds to a channel of the multi-channel signal to be reconstructed.

By reproducing the same processing in each of the frequency bands, the complete Fourier transforms of the channels of the signal to be reconstructed are reconstructed for the current temporal frame. The corresponding temporal signals are then obtained by inverse Fourier transform $T^{-1}$, with the aid of a fast algorithm implemented by the inverse transform module 640.

This therefore yields the multi-channel signal $S_m$ on the current temporal frame. The various temporal frames are thereafter combined by conventional overlap-add procedure so as to reconstruct the complete multi-channel signal.

Generally, temporal or frequency smoothings of the parameters will be able to be used equally well during analysis and during synthesis to ensure soft transitions in the sound scene. A signaling of a sharp change in the sound scene may be reserved in the binary stream so as to avoid the smoothings of the decoder in the case where a fast change in the composition of the sound scene is detected. Moreover, conventional procedures for adapting the resolution of the time-frequency analysis may be used (change of size of the analysis and synthesis windows over time).

In the same manner as at the coder, a base change module can perform a pre-processing so as to obtain a plane wave decomposition of the signals, a base change module 670 performs the inverse operation $P^{-1}$ with the help of the plane wave signals so as to retrieve the original multi-channel signal.

The coders and decoders such as described with reference to FIGS. 2 and 6 may be integrated into multimedia equipment such as a home decoder ("set-top box"), computer or else communication equipment such as a mobile telephone or personal electronic diary.

FIG. 7*a* represents an example of such an item of multimedia equipment or coding device comprising a coder according to the invention. This device comprises a processor PROC cooperating with a memory block BM comprising a storage and/or work memory MEM.

The device comprises an input module able to receive a multi-channel signal representing a sound scene, either through a communication network, or by reading a content stored on a storage medium. This multimedia equipment can also comprise means for capturing such a multi-channel signal.

The memory block BM can advantageously comprise a computer program comprising code instructions for the implementation of the steps of the coding method within the meaning of the invention, when these instructions are executed by the processor PROC, and especially the steps of decomposing the multi-channel signal into frequency bands and the following steps per frequency band:

- obtaining of data representative of the direction of the sound sources of the sound scene;
- selection of a set of sound sources of the sound scene constituting principal sources;
- adaptation of the data representative of the direction of the selected principal sources, as a function of restitution characteristics of the multi-channel signal;
- determination of a matrix for mixing the principal sources as a function of the adapted data;
- matrixing of the principal sources by the matrix determined so as to obtain a sum signal with a reduced number of channels;
- coding of the data representative of the direction of the sound sources and formation of a binary stream comprising the coded data, the binary stream being able to be transmitted in parallel with the sum signal.

Typically, the description of FIG. 2 employs the steps of an algorithm of such a computer program. The computer program can also be stored on a memory medium readable by a reader of the device or downloadable to the memory space of the equipment.

The device comprises an output module able to transmit a binary stream Fb and a sum signal Ss which arise from the coding of the multi-channel signal.

In the same manner, FIG. 7*b* illustrates an exemplary item of multimedia equipment or decoding device comprising a decoder according to the invention.

This device comprises a processor PROC cooperating with a memory block BM comprising a storage and/or work memory MEM.

The device comprises an input module able to receive a binary stream Fb and a sum signal $S_s$ originating for example from a communication network. These input signals can originate from reading on a storage medium.

The memory block can advantageously comprise a computer program comprising code instructions for the implementation of the steps of the decoding method within the meaning of the invention, when these instructions are executed by the processor PROC, and especially the steps of extraction from the binary stream and of decoding of data representative of the direction of the sound sources in the sound scene;

adaptation of at least some of the direction data as a function of restitution characteristics of the multi-channel signal;

determination of a matrix for mixing the sum signal as a function of the adapted data and calculation of an inverse mixing matrix;

dematrixing of the sum signal by the inverse mixing matrix so as to obtain a set of principal sources;

reconstruction of the multi-channel audio signal by spatialization at least of the principal sources with the decoded extracted data.

Typically, the description of FIG. 6 employs the steps of an algorithm of such a computer program. The computer program can also be stored on a memory medium readable by a reader of the device or downloadable to the memory space of the equipment.

The device comprises an output module able to transmit a multi-channel signal decoded by the decoding method implemented by the equipment.

This multimedia equipment can also comprise restitution means of loudspeaker type or communication means able to transmit this multi-channel signal.

Quite obviously, such multimedia equipment can comprise at one and the same time the coder and the decoder according to the invention, the input signal then being the original multi-channel signal and the output signal, the decoded multi-channel signal.

The invention claimed is:

1. A method for coding a multi-channel audio signal representing a sound scene comprising a plurality of sound sources, comprising:

decomposing the multi-channel signal into frequency bands; and obtaining data representative of a direction of the sound sources of the sound scene;

selecting a set of sound sources of the sound scene constituting principal sources;

adapting the data representative of the direction of the selected principal sources, as a function of restitution characteristics of the multi-channel signal, by modification of a position of the sources to obtain a separation between two sources;

determining a matrix for mixing the principal sources as a function of the adapted data;

matrixing the principal sources by the matrix determined to obtain a sum signal with a reduced number of channels; and coding the data representative of the direction of the sound sources and formation of a binary stream comprising the coded data, the binary stream being transmittable in parallel with the sum signal.

2. The method as claimed in claim 1, wherein the data representative of the direction are information regarding directivities representative of a distribution of the sound sources in the sound scene.

3. The method as claimed in claim 2, wherein the coding of the information regarding directivities is performed by a parametric representation procedure.

4. The method as claimed in claim 2, wherein the coding of the directivity information is performed by a principal component analysis procedure delivering base directivity vectors associated with gains allowing the reconstruction of the initial directivities.

5. The method as claimed in claim 2, wherein the coding of the directivity information is performed by a combination of a principal component analysis procedure and of a parametric representation procedure.

6. The method as claimed in claim 1, comprising coding secondary sources from among unselected sources of the sound scene and inserting coding information for the secondary sources into the binary stream.

7. A method for decoding a multi-channel audio signal representing a sound scene comprising a plurality of sound sources, with the help of a binary stream and of a sum signal, comprising:

extracting from the binary stream and decoding data representative of the direction of the sound sources in the sound scene;

adapting at least some of the direction data as a function of restitution characteristics of the multi-channel signal, by modifying a position of the sources obtained by the direction data, to obtain a separation between two sources;

determining a matrix for mixing the sum signal as a function of the adapted data and calculation of an inverse mixing matrix;

dematrixing the sum signal by the inverse mixing matrix to obtain a set of principal sources; and reconstructing the multi-channel audio signal by spatialization at least of the principal sources with the decoded extracted data.

8. The decoding method as claimed in claim 7, further comprising:

extracting, from the binary stream, coding information for coded secondary sources;

decoding the secondary sources with the help of the coding information extracted; and grouping the secondary sources with the principal sources for the spatialization.

9. A coder of a multi-channel audio signal representing a sound scene comprising a plurality of sound sources, the decoder being configured for:

decomposing the multi-channel signal into frequency bands;

obtaining data representative of a direction of the sound sources of the sound scene;

selecting a set of sound sources of the sound scene constituting principal sources;

adapting the data representative of the direction of the selected principal sources, as a function of restitution characteristics of the multi-channel signal, by an element for modifying a position of the sources to obtain a separation between two sources;

determining a matrix for mixing the principal sources as a function of the data arising from the adaptation module;

matrixing the principal sources selected by the matrix determined to obtain a sum signal with a reduced number of channels;

coding the data representative of the direction of the sound sources; and forming a binary stream comprising the coded data, the binary stream being transmittable in parallel with the sum signal.

10. A decoder of a multi-channel audio signal representing a sound scene comprising a plurality of sound sources, that receives as input a binary stream and a sum signal, the decoder being configured for:

extracting and decoding data representative of a direction of the sound sources in the sound scene;

adapting at least some of the direction data as a function of restitution characteristics of the multi-channel signal, by an element for modifying the position of the sources obtained by the direction data, to obtain a separation between two sources;

determining a matrix for mixing the sum signal as a function of the data arising from the module for adapting and for calculating an inverse mixing matrix;

dematrixing the sum signal by the inverse mixing matrix to obtain a set of principal sources; and reconstructing the multi-channel audio signal by spatialization at least of the principal sources with the decoded extracted data.

11. A non-transitory computer program product comprising code instructions for the implementation of the steps at least one of the coding method as claimed in claim 1 and of the decoding method for decoding a multi-channel audio signal representing a sound scene comprising a plurality of sound sources, with the help of a binary stream and of a sum signal, comprising:

extracting from the binary stream and decoding data representative of the direction of the sound sources in the sound scene;

adapting at least some of the direction data as a function of restitution characteristics of the multi-channel signal, by modifying a position of the sources obtained by the direction data, to obtain a separation between two sources;

determining a matrix for mixing the sum signal as a function of the adapted data and calculating an inverse mixing matrix;

dematrixing the sum signal by the inverse mixing matrix to obtain a set of principal sources; and reconstructing the multi-channel audio signal by spatialization at least of the principal sources with the decoded extracted data, when these instructions are executed by a processor.

* * * * *